US008157713B1

(12) United States Patent
Siskowic et al.

(10) Patent No.: US 8,157,713 B1
(45) Date of Patent: Apr. 17, 2012

(54) ATTACHABLE EXERCISE DEVICE AND METHOD OF USE THEREOF

(76) Inventors: Steve Siskowic, Fort Worth, TX (US); Caroline Siskowic, Fort Worth, TX (US)

( * ) Notice: Subject to any disclaimer, the term of this patent is extended or adjusted under 35 U.S.C. 154(b) by 0 days.

(21) Appl. No.: 12/881,476

(22) Filed: Sep. 14, 2010

(51) Int. Cl.
*A63B 71/00* (2006.01)

(52) U.S. Cl. ..... 482/141

(58) Field of Classification Search ..... 482/140–142, 482/44, 62
See application file for complete search history.

(56) References Cited

U.S. PATENT DOCUMENTS

| | | | | |
|---|---|---|---|---|
| 3,115,338 | A * | 12/1963 | Acs et al. | 482/141 |
| 3,384,370 | A | 5/1968 | Bailey et al. | |
| 4,580,751 | A * | 4/1986 | Panzer | 248/205.8 |
| 4,822,031 | A | 4/1989 | Olschewski | |
| 5,024,434 | A | 6/1991 | Smith | |
| 5,306,217 | A | 4/1994 | Bracone | |
| 5,407,405 | A | 4/1995 | Oren | |
| 5,480,140 | A | 1/1996 | Darnell | |
| 5,639,134 | A | 6/1997 | Rusch et al. | |
| 6,154,929 | A | 12/2000 | Dwyer | |
| 6,186,930 | B1 * | 2/2001 | Ignaczak | 482/141 |
| D490,201 | S | 5/2004 | Liao | |
| 7,377,888 | B2 * | 5/2008 | Godbold | 482/141 |
| 7,468,025 | B2 * | 12/2008 | Hauser et al. | 482/141 |
| 7,503,884 | B1 * | 3/2009 | Schall | 482/141 |
| 7,553,267 | B1 * | 6/2009 | Hauser et al. | 482/141 |
| 7,665,706 | B2 * | 2/2010 | Chien et al. | 248/542 |
| 7,896,788 | B1 * | 3/2011 | Schall | 482/141 |
| 7,935,040 | B2 * | 5/2011 | Moskowich | 482/141 |
| 2006/0014615 | A1 * | 1/2006 | Godbold | 482/141 |
| 2006/0249638 | A1 * | 11/2006 | Ehrke | 248/205.5 |
| 2007/0184951 | A1 * | 8/2007 | James et al. | 482/141 |
| 2009/0186751 | A1 * | 7/2009 | Hauser et al. | 482/141 |
| 2010/0144502 | A1 * | 6/2010 | Hinds et al. | 482/139 |
| 2010/0317496 | A1 * | 12/2010 | Abranchess | 482/141 |
| 2011/0077136 | A1 * | 3/2011 | Tozzi | 482/141 |

OTHER PUBLICATIONS

Perfect Pushup. Perfect Fitness. http://www.perfectonline.com/store/index.php/products/perfect-pushup.html. Accessed Nov. 11, 2009.

* cited by examiner

*Primary Examiner* — Stephen Crow
(74) *Attorney, Agent, or Firm* — Montgomery Patent & Design, LLC; Robert C. Montgomery; Joseph T. Yaksich

(57) ABSTRACT

An attachable exercise apparatus comprising a rotating handle assembly, a base, and a suction cup for mounting the apparatus to a flat surface, is herein disclosed. The handle assembly comprises an ergonomic cylindrical shape which spans an "L"-shaped frame. The suction cup comprises a large circular suction cup permanently attached to a bottom surface of the base and provides a lever mechanism to create an internal vacuum which allows the apparatus to be securely removably attached to a flat surface such as a pool wall, a gymnasium wall, a floor surface, and the like. The handle and frame are constructed of a hard, durable material, and the handle comprises a textured or coated slip resistant surface. The flat circular base allows the handle to rotate or be locked in position, while the base and suction cup remain stationary.

13 Claims, 4 Drawing Sheets

ATTACHABLE EXERCISE DEVICE AND METHOD OF USE THEREOF

RELATED APPLICATIONS

The present invention was first described in a notarized Official Record of Invention on Aug. 28, 2009, that is on file at the offices of Montgomery Patent and Design, LLC, the entire disclosures of which are incorporated herein by reference.

FIELD OF THE INVENTION

The present invention relates generally to exercise equipment, and in particular, to a gripping means particularly adapted for use with swimming pool exercise routines.

BACKGROUND OF THE INVENTION

Physical fitness and health concerns are among the areas of highest concern among people in the world today. More than ever, people are frequenting health clubs and performing exercise routines at home in order to lose weight, improve muscle tone, and maintain a healthy lifestyle. Many people turn to exercise routines that are performed in a pool due to their low impact properties, which reduces the occurrence of muscular-skeletal side effects. Most of these routines or exercises require the user to stay in one place, such as while swimming in place, or performing balancing type routines. In such cases, the users attempt to stay in position by holding onto the side or edge of the pool.

One (1) problem associated with such pool exercises is that the grip afforded by the edge of the pool is often insufficient to secure a person, largely due to its flat contours and lack of suitable gripping materials. Additionally, the surface may be slippery due to the fact that it is covered in water. Another frequently encountered difficult is when there exists a large difference between the water line and the top edge of the pool. Lack of proper grip severely inhibits both the range of available suitable exercise routines and the effectiveness of those which are undertaken.

Various attempts have been made to provide gripping devices to aid a user during exercise routines. Examples of these attempts can be seen by reference to several U.S. patents. U.S. Pat. No. 4,822,031, issued in the name of Olschewski, describes a pool exercise device which provides a rotatingly height adjustable horizontal bar gripping means which is detachable from a pair of supports installed within the wall of a pool.

U.S. Pat. No. 5,306,217, issued in the name of Bracone, describes a swimming pool ballet bar which is attached to a flat ground surface adjacent to a pool structure and which provide a horizontal gripping bar near a wall of the pool for aid in performing pool exercises.

U.S. Pat. No. 5,407,405, issued in the name of Oren, describes a grip handle for physical exercises which provides a rotating handle mounted along a vertical surface.

While these devices fulfill their respective, particular objectives, each of these references suffer from one (1) or more of the aforementioned disadvantages. Many such devices are not suitable for use in water. Also, many such devices require permanent installation in a pool or the like. Furthermore, many such devices do not allow a full range of adjustability and motioning for a user's arms during use. In addition, many such devices are not readily usable and reusable in a large range of desired locations or positions. Accordingly, there exists a need for an exercise gripping device without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need to provide a secure gripping means for a user during swimming pool exercises in a manner which is removable, adjustable, and which provides a full range of motioning during exercise. Thus, the object of the present invention is to solve the aforementioned disadvantages and provide for this need.

To achieve the above objectives, it is an object of the present invention to provide a means for a user to perform various exercise movements and workouts within a swimming pool. The apparatus comprises a stationary base assembly and a rotating handle assembly.

Another object of the present invention is to removably mount to a wall portion of a pool structure to facilitate exercise routines performed within the water.

Yet still another object of the present invention is to allow for mounting to various other flat surfaces to aid in the performance of other types of exercises.

Yet still another object of the present invention is to be utilized alone or in pairs to facilitate various exercises requiring support of either one or both hands.

Yet still another object of the present invention is to provide removable attachment to flat surfaces in a manner which does not damage the surface. The stationary base assembly comprises a suction cup which produces a suction force upon a flat surface for secure positioning. The suctioning force is controllable via a suction lever located on an exterior portion of the suction cup.

Yet still another object of the present invention is to provide a removably attachable handle and frame assembly which connects to the base assembly. The handle comprises a cylindrical-shaped grip affixed to the frame parallel to the mounting surface.

Yet still another object of the present invention is to comprise the handle of a textured or coated slip-resistant gripping surface.

Yet still another object of the present invention is to allow full circular rotation of the handle and frame assemblies relative to the base in a plane parallel to the mounting surface, in order to facilitate movement of a user's hands and arms during exercise routines.

Yet still another object of the present invention is to provide a means to lock the handle assembly in a desired position relative to the base via an internal locking pin and hub post assembly. This allows a user to provide a stationary grip as desired for particular exercise routines.

Yet still another object of the present invention is to provide a method of utilizing the device that provides a unique means of procuring one or more instances of the apparatus, placing the apparatus over a desired flat surface, providing a suction force to hold the apparatus in place via the suction lever, attaching the handle assembly to the base assembly, selectively allowing or disallowing the rotating motion of the handle assembly as desired based upon the necessities of desired exercise routines, utilizing more than one of the apparatus in tandem as desired, and adjusting or relocating the relative position of the apparatuses as necessary.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| DESCRIPTIVE KEY | |
|---|---|
| 10 | attachable exercise device |
| 20 | handle assembly |
| 21 | grip |
| 22 | axle |
| 23 | gripping surface |
| 24 | frame |
| 26 | hub receiver |
| 28 | locking housing |
| 30 | protrusion |
| 32 | first detent |
| 33 | second detent |
| 40 | locking knob |
| 42 | locking pin |
| 60 | base assembly |
| 62 | base plate |
| 63 | operational indicia |
| 64 | hub post |
| 66 | slot |
| 68 | aperture |
| 80 | suction cup |
| 90 | suction lever |
| 92 | suction rod |
| 94 | rod offset portion |
| 96 | actuator rod |
| 100 | suction zone |
| 150 | flat surface |
| 160 | user |
| 170 | pool structure |
| 180 | water surface |
| 190 | adhesive |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
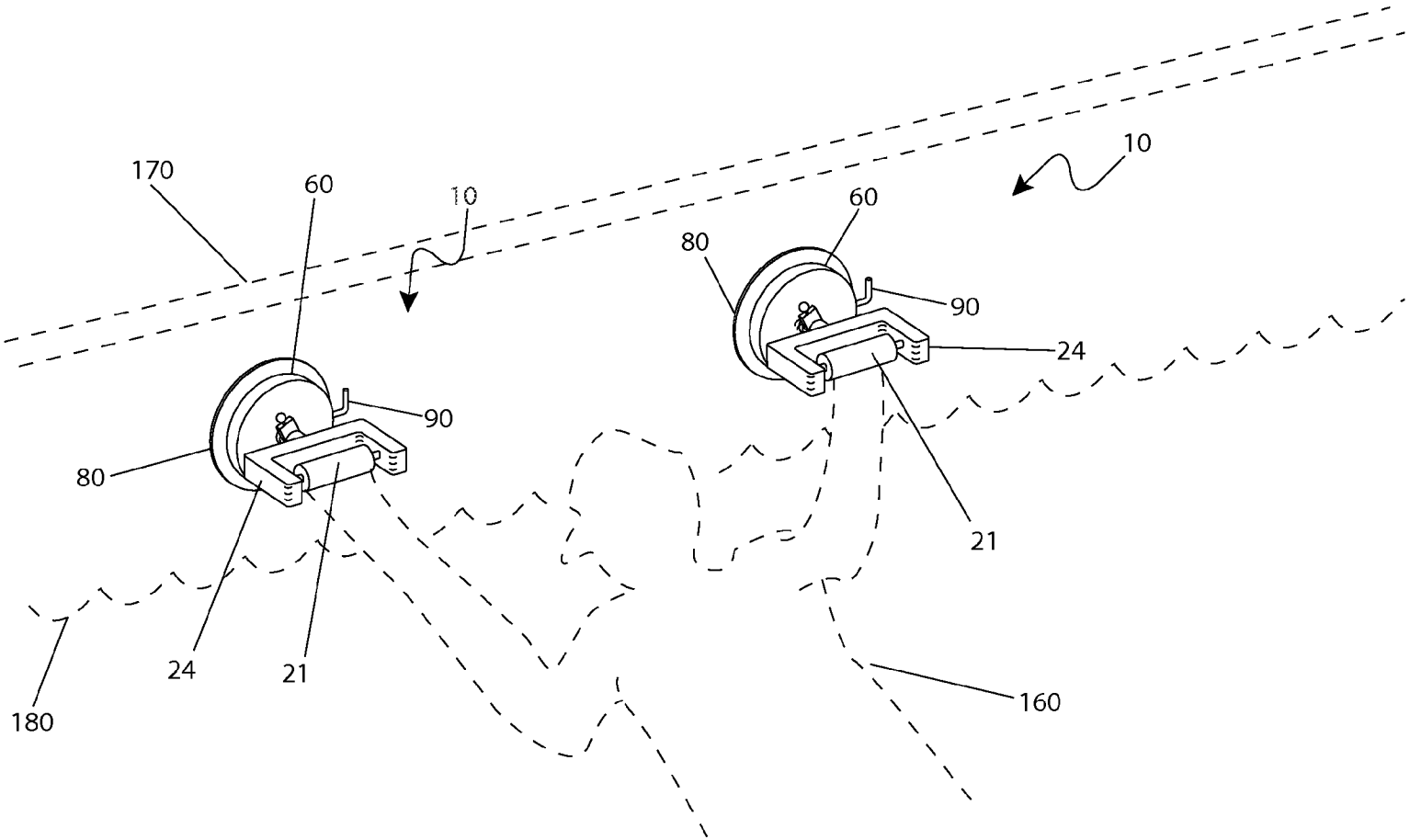
FIG. 1 is an environmental view of an attachable exercise device 10, according to a preferred embodiment of the present invention.

Referring now to FIG. 1, an environmental view of the apparatus 10, according to a preferred embodiment of the present invention, is disclosed. The present invention describes an attachable exercise device (herein described as the "apparatus") 10, which provides a means for a user 160 to perform various exercise movements and workouts while grasping one (1) or two (2) units of the apparatus 10 being secured to flat surface 150. According to a preferred method of use; two (2) units of the apparatus 10 are shown here being mounted to a wall portion of a pool structure 170 just above a water surface 180, allowing a user 160 to perform various aquatic-based exercises. However, the apparatus 10 may be mounted to various other flat surfaces 150 such as gymnasium walls, floor surfaces, and the like, to aid in the performance of various other types of exercises, and as such should not be interpreted as a limiting factor of the apparatus 10. The apparatus 10 comprises a stationary base assembly 60 and a rotating handle assembly 20 which provides an ergonomic cylinder-shaped grip 21. The apparatus 10 is secured to the flat surface 150 via a circular suction cup 80 approximately six (6) to ten (10) inches in diameter being similar in diameter to that of the base assembly 60 and to a width of the handle assembly 20. Furthermore, the apparatus 10 is envisioned being introduced as a single unit 10 or as a pair of devices 10, thereby providing a means for a user 160 to perform various aquatic or similar exercises.

Figure 2:
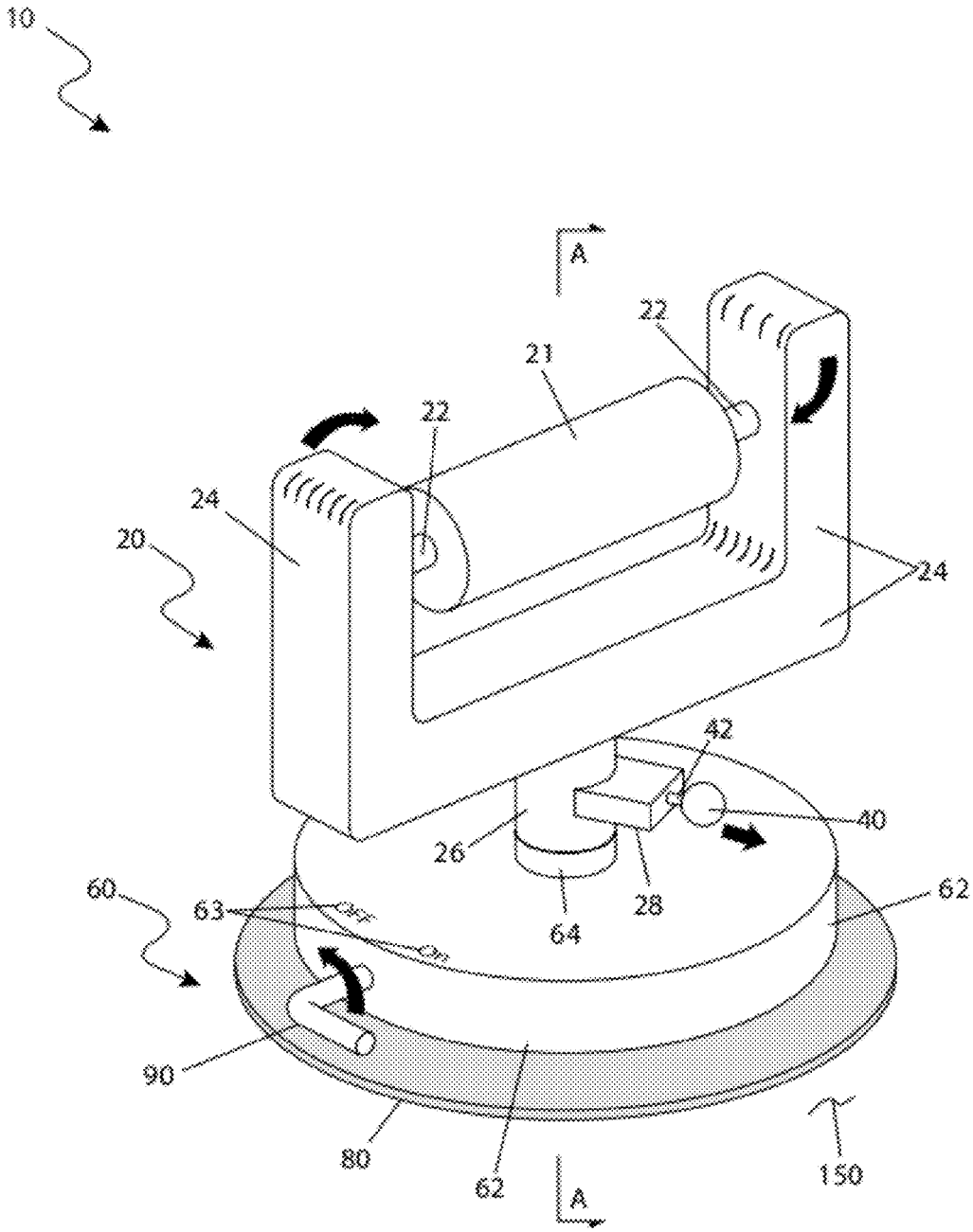
FIG. 2 is a perspective view of the attachable exercise device 10, according to a preferred embodiment of the present invention.
Figure 3:
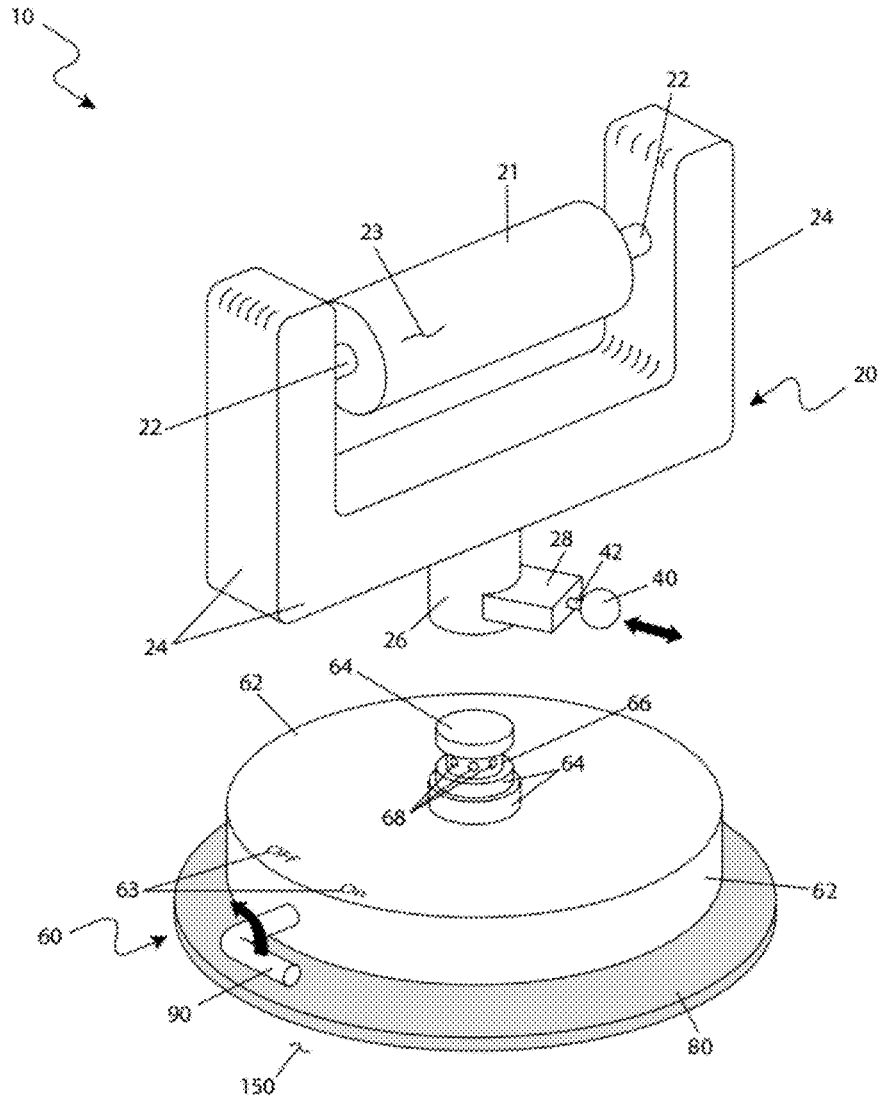
FIG. 3 is an exploded view of the attachable exercise device 10, according to a preferred embodiment of the present invention; and, FIG. 4 is a section view of the attachable exercise device 10 taken along section line A-A (see FIG. 2), according to a preferred embodiment of the present invention.

Referring now to FIGS. 2 and 3, perspective and section views of the apparatus 10, according to a preferred embodiment of the present invention, are disclosed. The apparatus 10 is illustrated here in a vertical orientation upon a horizontal flat surface 150 having the handle assembly portion 20 extended upwardly. The handle assembly 20 comprises a cylindrical-shaped grip 21 spanning a "U"-shaped frame 24 and being affixed thereto said frame 24 via a linear horizontal axle 22. The frame 24 provides a removable attachment means to the base assembly 60 via a centrally located and downwardly extending hub receiver 26. The hub receiver 26 comprises an integral hollow cylindrical structure into which a hub post portion 64 of said base assembly 60 is inserted. Furthermore, said hub receiver 26 provides integral features which allow the handle assembly 20 to freely rotate three-hundred and sixty (360) degrees relative to the base assembly 60. The hub receiver 26 further comprises a locking housing 28 which provides enclosure of an internal locking pin 42 having an external locking knob 40. The locking pin 42 is to engage the hub post 64, thereby allowing the handle assembly 20 to either freely rotate or be locked in position at a fixed angle (see FIG. 4). The handle assembly 20 is envisioned to be constructed of a hard, durable material such as plastic and/or metal, being introduced in various decorative colors and patterns. Furthermore, the grip portion 21 is envisioned to have a textured or coated slip resistant gripping surface 23.

The base assembly 60 comprises a base plate 62, a hub post 64, a suction cup 80, and a suction lever 90. The base plate 62 comprises a low-profile cylindrical form approximately six (6) to ten (10) inches in diameter, having a closed top surface, and an arcuate concave bottom surface. The top surface of the base plate 62 comprises an integral and centrally-located hub post 64 protruding perpendicularly upward from said base plate 62 as seen here. The hub post 64 comprises an annular slot 66 and a plurality of equally-spaced apertures 68 within said slot 66. Said slot 66 and apertures 68 enable mechanical engagement with the aforementioned locking pin 42 (see FIG. 4). The base plate 62 and hub post 64 portions are envisioned to be constructed of a hard, durable material such as plastic and/or metal, being introduced in various decorative colors and patterns.

The base plate 62 provides an attachment means to the suction cup 80 along a bottom surface of said base plate 62, and is envisioned being made using rubber, latex, or an equivalent flexible sealing material. The cup-shaped suction cup 80 provides an inner suction zone 100 which acts upon the flat surface 150 when in contact, to produce a suction force produced by manual rotation of an outwardly extending suction lever 90, thereby increasing or decreasing a pressure within said suction zone 100 (see FIG. 4).

Figure 4:
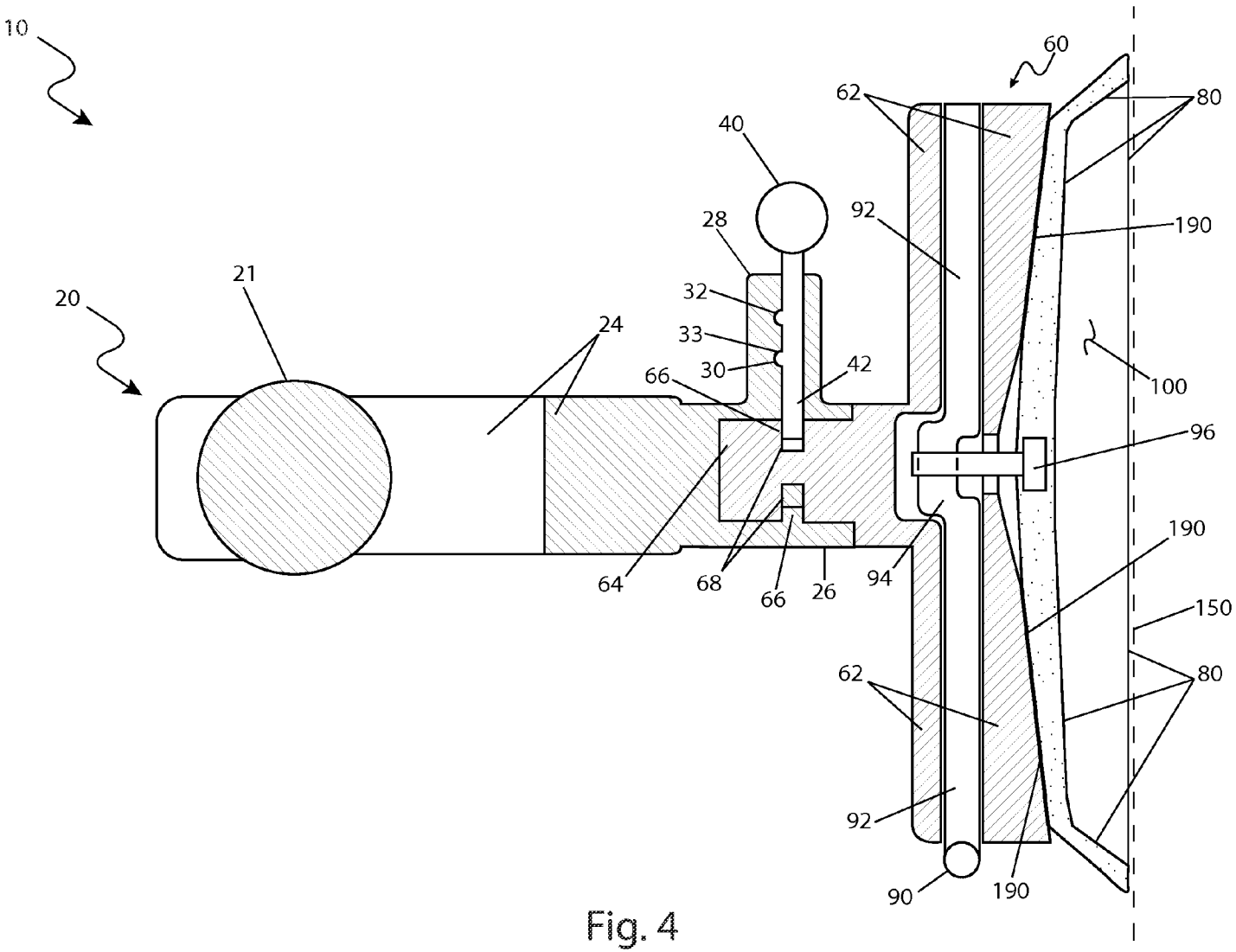

Referring now to FIG. 4, a section view of the apparatus 10 taken along section line A-A (see FIG. 2), according to a preferred embodiment of the present invention, is disclosed. The apparatus 10 is depicted here in a horizontal orientation being affixed to a vertical flat surface 150. The apparatus 10 comprises a locking pin 42, a slot 66, and a plurality of locking apertures 68. The locking pin 42 and locking housing 28 provide relative incremental engagement via interfering molded features. The locking pin 42 is incrementally motioned in a linear manner within a bored hole portion of the locking housing 28 by a user 160 using the permanently attached locking knob 40. The locking pin 42 comprises a corresponding annular protrusion 30 located at an intermediate position along its length. The protrusion 30 provides slight mechanical engagement with a first detent feature 32 and a second detent feature molded or machined in an annular manner within the hole portion of the locking housing 28. Positive mechanical engagement of the protrusion 30 and the detents 32, 33 allow the locking pin 42 to respectively engage the slot 66 and aperture 68 portions of the hub post 64, thereby providing three (3) versatile operational functions. First, the locking pin 42 may be withdrawn completely from the locking housing 28, thereby allowing easy removal of the handle assembly 20 from the stationary base assembly 60. Secondly, the locking pin 42 may be partially inserted into the locking housing 28 until the protrusion 30 engages the first detent 32, thereby causing an end portion of said locking pin 42 to engage the slot 66 and allowing the handle assembly 20 to rotate freely in a three-hundred and sixty (360) degree circle. Thirdly, said locking pin 42 may be inserted further until the protrusion 30 engages the second detent 33, thereby causing an end portion of said locking pin 42 to engage an aligned aperture 68, and arresting the rotary motion of the handle assembly 20 at a particular desired rotated position.

The apparatus 10 provides an internal mechanism to produce a reduction of pressure within the suction zone 100 being formed between the suction cup 80 and the flat surface 150. The base assembly 60 portion of the apparatus 10 comprises a suction lever 90, a suction rod 92, and an actuator rod 96. The suction lever 90 and suction rod 92 form a torsion rod mechanism which extends through the base plate 62, thereby providing motioning of the suction cup 80 via an interconnected actuator rod 96. The suction rod 92 comprises a centrally-located rod offset section 94 which provides a rotating attachment means between the suction rod 92 and the actuator rod 96, thereby forming a crank and connecting rod mechanism which causes the actuator rod 96 to reciprocate in a perpendicular direction with respect to the suction rod 92 upon rotation of the suction lever 90. An end portion of the actuator rod 96 is envisioned to be permanently molded into, or otherwise affixed to a central portion of the suction cup 80, thereby resulting in a respective reciprocating motion of a center region of the suction cup 80 upon rotation of the suction rod 92. The bottom arcuate surface of the base plate 62 provides supportive attachment thereto an upper perimeter region of the suction cup 80 via common industrial adhesives 190, thereby supporting the suction cup 80 as anticipated forces are applied to the handle assembly portion 20 of the apparatus 10 during use. Operational indicia 63 is imprinted onto the base plate 62 adjacent to the section lever 90, in order to direct the user 160 on current positioning of the suction cup 80. In use, if the suction lever is pointing toward an "OFF" position, the internal pressure within the suction zone 100 is normalized, thereby allowing removal of the apparatus 10 from the flat surface 150 (see FIG. 2). Conversely, when the suction lever 90 is rotated toward an "ON" position, the suction cup 80 is expanded upwardly, thereby increasing an amount of suction within the suction zone 100 to secure the apparatus 10 to the flat surface 150.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user 160 in a simple and effortless manner with little or no training. After initial purchase or acquisition of the apparatus 10, it would be installed as indicated in FIGS. 1 and 3.

The method of installing and utilizing the apparatus 10 may be achieved by performing the following steps: procuring the apparatus 10; selecting a flat surface 150 onto which to mount the apparatus 10 being suitably positioned to perform a desired exercise or similar activity; installing the apparatus 10 by pressing the suction cup portion 80 of the apparatus 10 against said flat surface 150; flipping the suction lever 90 to the "ON" position of the operational indicia 63 to produce a suction within the suction cup 80, thereby securing the base assembly portion 60 of the apparatus 10 to the flat surface 150; attaching the handle assembly 20, if not previously installed, by pulling the locking knob 40 outwardly; inserting the hub post 64 into the hub receiver 26; pressing the locking knob 40 inwardly into the locking housing 28 until the protrusion portion 30 of the locking pin 42 engages the first detent 32, thereby engaging the slot 66 portion of the hub post 64; grasping the grip portion 21 of the handle assembly 20 to perform desired aquatic exercises or similar activities; and, benefiting from a removable, portable, and versatile exercise aid to enhance aquatic and other exercises while utilizing the present apparatus 10.

In order to remove the apparatus 10 from the flat surface 150 the user 160 must flip the suction lever 90 to the "OFF" position of the operation indicia 63 to eliminate suction within the suction cup 80, thereby freeing the apparatus 10 from said flat surface 150.

Furthermore, a second unit of the apparatus 10 may be procured and utilized in conjunction with the previously installed unit 10. Said second unit of the apparatus 10 may be installed as described above, by repeating the above steps, thereby allowing a user 160 to perform additional exercises requiring a pair of apparatus units 10 being spaced apart and gripped using both hands (see FIG. 1).

The apparatus 10 may be configured in a non-rotating manner by performing the following additional steps: locking the handle assembly portion 20 at a fixed angular position in relation to the base assembly 60 by pressing the locking knob 40 further toward the locking housing 28 until the protrusion portion 30 of the locking pin 42 engages the second detent 33; engaging the locking pin 42 into an aligned aperture portion 68 of the hub post 64; and utilizing the handle assembly 20 at a fixed angle to perform various additional exercises which require the apparatus 10 not to rotate.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An attachable exercise device for assisting a user to perform various aquatic-based exercise movements and workouts in a body of water, said attachable exercise device comprising:

a stationary base assembly including a suction cup adapted to be mounted to a wall portion of the body of water just above a water surface thereof, further comprising:

a base plate having a closed top surface and an arcuate bottom surface, said bottom surface of said base plate being attached to said suction cup;

a hub post having an annular slot and a plurality of apertures situated within said slot, said hub post protruding perpendicularly upward from said top surface of said base plate;

a suction lever;

a suction rod attached to said suction lever and having a centrally-located offset section; and, an actuator rod having an end portion permanently affixed to said suction rod and a central portion of said suction cup; and, a rotating handle assembly including a downwardly extending hub receiver;

wherein said hub receiver is removably attached to said stationary base and allows said handle assembly to freely rotate 360 degrees relative to said base assembly.

2. The attachable exercise device of claim 1, wherein said suction cup has an inner suction zone producing a suction force when said suction lever is rotated.

3. The attachable exercise device of claim 1, wherein, upon rotation of said suction lever, said centrally-located offset section is rotated thereby causing said actuator rod to reciprocate along a perpendicular direction with respect to said suction rod.

4. The attachable exercise device of claim 1, wherein a central portion of said suction cup reciprocates upon rotation of said suction rod.

5. The attachable exercise device of claim 1, wherein said rotating handle assembly comprises:

a U-shaped frame attached to said hub receiver;

a linear horizontal axle; and, a grip affixed to said linear horizontal axle.

6. The attachable exercise device of claim 1, wherein said hub receiver comprises:

a locking housing having a first detent and a second detent;

an internal locking pin having a corresponding annular protrusion located at an intermediate position along a length thereof; and, an external locking knob;

wherein said locking pin engages said hub post thereby allowing said handle assembly to selectively rotate as well as lock at a fixed angle;

wherein said internal locking pin incrementally and linearly engages said locking housing; and, wherein said protrusion is selectively engaged with one of said first and second detents within said locking housing.

7. An attachable exercise device for assisting a user to perform various aquatic-based exercise movements and workouts in a body of water, said attachable exercise device comprising:

a stationary base assembly including a suction cup adapted to be mounted to a wall portion of the body of water just above a water surface thereof, further comprising:

a base plate having a closed top surface and an arcuate bottom surface, said bottom surface of said base plate being attached to said suction cup;

a hub post having an annular slot and a plurality of apertures situated within said slot, said hub post protruding perpendicularly upward from said top surface of said base plate;

a suction lever;

a suction rod attached to said suction lever and having a centrally-located offset section; and, an actuator rod having an end portion permanently affixed to said suction rod and a central portion of said suction cup; and, a rotating handle assembly including a downwardly extending hub receiver having a hollow structure;

wherein said hub receiver is removably attached to said stationary base and allows said handle assembly to freely rotate 360 degrees relative to said base assembly.

8. The attachable exercise device claim 7, wherein said suction cup has an inner suction zone producing a suction force when said suction lever is rotated.

9. The attachable exercise device claim 7, wherein, upon rotation of said suction lever, said centrally-located offset section is rotated thereby causing said actuator rod to reciprocate along a perpendicular direction with respect to said suction rod.

10. The attachable exercise device claim 7, wherein a central portion of said suction cup reciprocates upon rotation of said suction rod.

11. The attachable exercise device of claim 7, wherein said rotating handle assembly comprises:

a U-shaped frame attached to said hub receiver;

a linear horizontal axle; and, a grip affixed to said linear horizontal axle.

12. The attachable exercise device of claim 7, wherein said hub receiver comprises:

a locking housing having a first detent and a second detent;

an internal locking pin having a corresponding annular protrusion located at an intermediate position along a length thereof; and, an external locking knob;

wherein said locking pin engages said hub post thereby allowing said handle assembly to selectively rotate as well as lock at a fixed angle;

wherein said internal locking pin incrementally and linearly engages said locking housing; and, wherein said protrusion is selectively engaged with one of said first and second detents within said locking housing.

13. A method of utilizing an attachable exercise device for assisting a user to perform various aquatic-based exercise movements and workouts in a body of water, said method comprising the steps of:

providing a stationary base assembly, further comprising:

a base plate having a closed top surface and an arcuate bottom surface, said bottom surface of said base plate being attached to said suction cup;

a hub post having an annular slot and a plurality of apertures situated within said slot, said hub post protruding perpendicularly upward from said top surface of said base plate;

a suction lever;

a suction rod attached to said suction lever and having a centrally-located offset section; and, an actuator rod having an end portion permanently affixed to said suction rod and a central portion of said suction cup;

providing a rotating handle assembly including a downwardly extending hub receiver having a hollow structure;

removably attaching said hub receiver to said stationary base;

mounting said suction cup to a wall portion of the body of water just above a water surface thereof; and, freely rotating said handle assembly 360 degrees relative to said base assembly.

* * * * *